United States Patent [19]

Scheinecker

[11] 4,156,453

[45] May 29, 1979

[54] DRIVING ROLL STAND

[75] Inventor: Alois Scheinecker, Linz, Austria

[73] Assignee: Vereinigte Österreichische Eisen- und Stahlwerke - Alpoine Montan Aktiengesellschaft, Linz, Austria

[21] Appl. No.: 886,629

[22] Filed: Mar. 15, 1978

Related U.S. Application Data

[63] Continuation of Ser. No. 749,106, Dec. 9, 1976, abandoned.

[30] Foreign Application Priority Data

Dec. 17, 1975 [AT] Austria ..... 9569/75

[51] Int. Cl.[2] ..... B22D 11/128

[52] U.S. Cl. ..... 164/448; 100/168; 226/194; 72/244

[58] Field of Search ..... 72/237, 244; 100/158 R, 100/168; 164/441, 442, 447, 448; 226/194

[56] References Cited

U.S. PATENT DOCUMENTS

| | | | |
|---|---|---|---|
| 1,157,378 | 10/1915 | Geer | 72/237 X |
| 2,180,046 | 11/1939 | Gleissner | 100/158 R |
| 3,055,242 | 9/1962 | Wilson | 100/168 X |
| 3,299,801 | 1/1967 | Bishop | 100/168 |
| 3,543,555 | 12/1970 | Baumann et al. | 164/448 X |
| 3,580,034 | 5/1971 | Wilson | 72/237 |
| 3,628,594 | 12/1971 | Reinfeld et al. | 164/270 |
| 3,776,014 | 12/1973 | Artz et al. | 72/249 X |

FOREIGN PATENT DOCUMENTS

| | | | |
|---|---|---|---|
| 709486 | 5/1954 | United Kingdom | 226/194 |

*Primary Examiner*—Othell M. Simpson
*Assistant Examiner*—J. Reed Batten, Jr.
*Attorney, Agent, or Firm*—Brumbaugh, Graves, Donohue & Raymond

[57] ABSTRACT

A driving roll stand, in particular to be used in a continuous casting plant, has a pair of rolls, at least one of the rolls being mounted in a rocker; the rocker is pivotably hinged to a stationary stand with one bearing on each roller-end side, and a displacement means for each bearing for displacing the bearing in the pivot plane of the rocker is provided.

3 Claims, 5 Drawing Figures

DRIVING ROLL STAND

This is a continuation of application Ser. No. 749,106 filed Dec. 9, 1976 and now abandoned.

The invention relates to a driving roll stand, in particular to be used in continuous casting plants, having a pair of rolls at least one of the rolls of which is mounted in a rocker, wherein the rocker at the side of the roll end is pivotably hinged with one bearing of the rocker each to a stationary stand.

In such driving roll stands, which can serve for extracting as well as for reducing the thickness of metal strands, the rolls must be arranged precisely parallel to each other in order to safeguard a faultless conveying of the strand. Deviations from the parallelism of the rolls, e.g. when the rolls are skew, ought to be kept as small as possible.

As regards the production, deviations from the parallelism of the rolls can only be avoided by extremely low tolerances, which is expensive and complicated. The rolls may also become skew due to wear, which necessitates an exchange of parts of the driving roll stand.

The invention aims at preventing these difficulties and has as its object to provide a driving roll stand, whose rolls are adjustable to be precisely parallel to one another, and whose production is simple, inexpensive and can be achieved with production tolerances requiring only little expenditures. Furthermore, it should also be possible to re-adjust the rolls without having to exchange parts of the driving roll stand, if deviations from the parallelism of the rolls occur due to wear.

In a driving roll stand of the above defined kind this object is achieved in that each one of the bearings of the rocker is displaceable by a displacement means in the pivot plane of the rocker, wherein advantageously the direction of displacement of the one bearing of the rocker is perpendicular to the direction of displacement of the other bearing of the rocker.

According to a preferred embodiment, eccentric bolts are provided as displacement means, which penetrate the bearings of the rocker and whose eccentricities are at a right angle to each other before the rocker is displaced.

Figure 1:
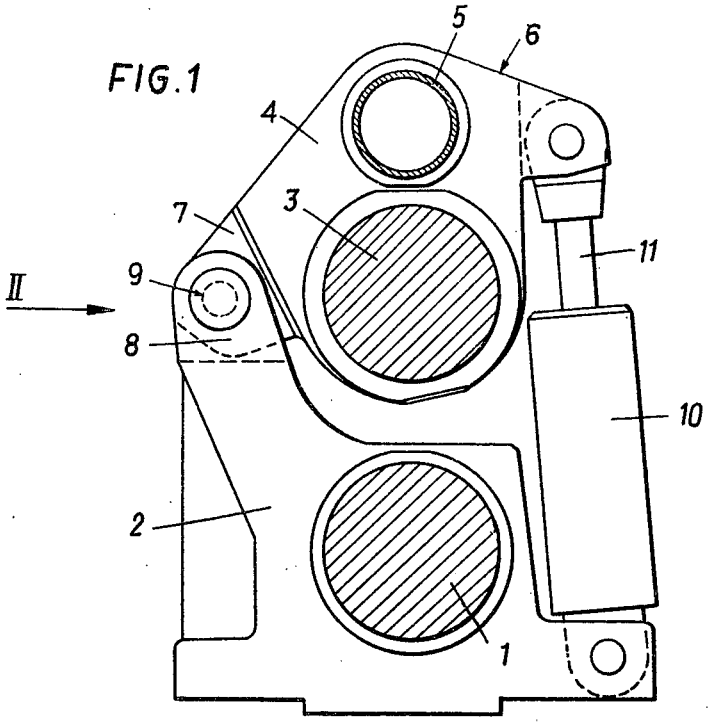
Figure 2:
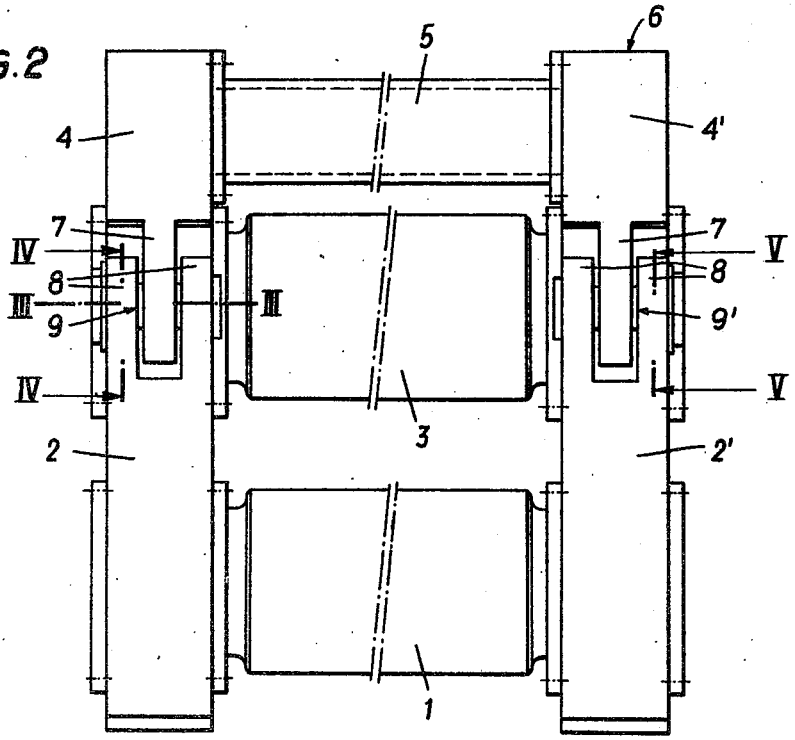
Figure 3:
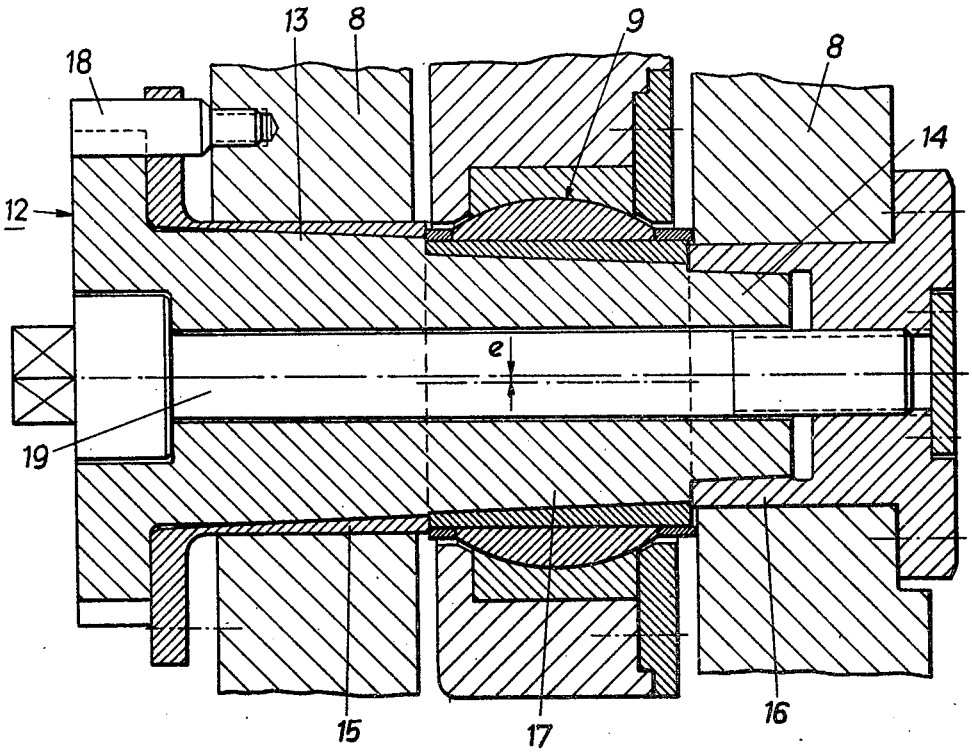
Figure 4:
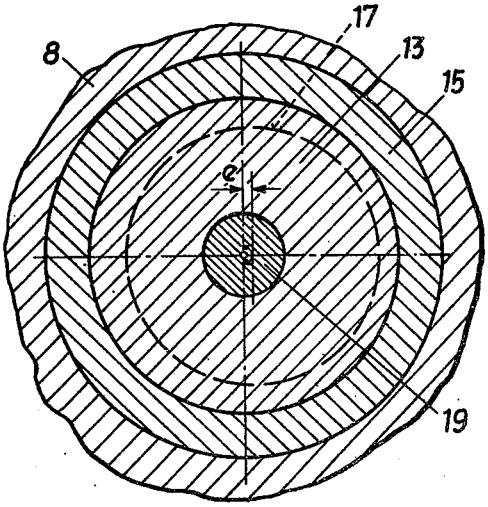
Figure 5:
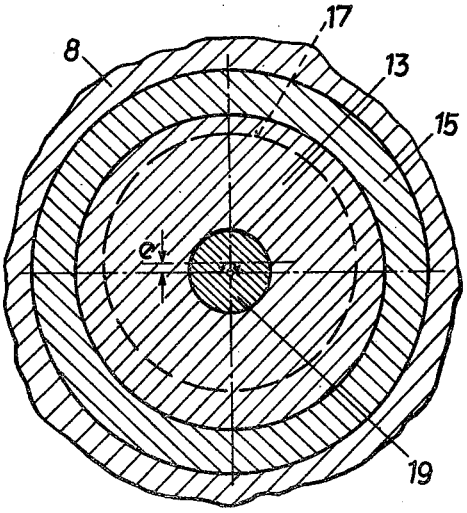

The invention shall now be described by way of example only and with reference to the accompanying drawings, wherein:

FIG. 1 is a section of a driving roll stand, perpendicular to the axes of the rolls, FIG. 2 is a view in the direction of the arrow II of FIG. 1, FIG. 3 is a partial illustration of a section along line III—III of FIG. 2 on an enlarged scale, and FIGS. 4 and 5 are partial sections on an enlarged scale along lines IV—IV and V—V of FIG. 2.

By 1 the lower roll is denoted, which is rotatably journaled with its ends in a stationary stand 2 and 2' screwed onto the base. The upper roll 3 is mounted in a rocker 6 comprising two side parts 4 and 4' connected by a pipe 5. Projections 7 of the side parts 4 and 4' engage in fork ends 8 of the stationary stand and are pivotably mounted thereon by one bearing 9 and 9' each of the rocker, designed as articulation bearings. The rolls can be driven via motors not illustrated.

Two pressure medium cylinders 10 hinged to the stationary stand 2 and 2', which are hinged to the rocker with their pistons 11 serve for adjusting the desired distance between the rolls.

One eccentric bolt 12 each penetrates the articulation bearings 9 and 9' and is mounted in the fork ends 8 with its concentrically arranged truncated cones 13 and 14 via bushings 15 and 16. Its middle portion 17, which also has the shape of a truncated cone, which penetrates each of the projections 7 of the rocker, is arranged to be eccentrical to the truncated cones 13 and 14 by the extent e. Thus a rotation of the eccentric bolt causes a displacement of the bearing of the rocker relative to the stationary stand 2 and 2'. Screw bolts 18 screwable into the stationary stand 2 and 2' penetrating recesses of the flange-like end of the truncated cone 13 secure the eccentric bolt against an undersired rotation. For securing the position of the eccentric bolt, there is furthermore provided a threaded bolt 19 penetrating the eccentric bolt, by which the eccentric bolt 12 is braceable relative to the bushing 16 surrounding the truncated cone 14 and fixed in the stationary stand 2 and 2' by means of screws. Prior to a precise adjustment of roll 3 to roll 1, the eccentricities of the eccentric bolts enclose a certain angle with each other, preferably an angle of 90°, as shown in FIGS. 4 and 5. This means that when the driving roll stand is made, care is taken that the rolls 1 and 3 with this position of the eccentric bolts are placed as parallel to each other as possible. By rotating the eccentric bolt allocated to the bearing 9 of the rocker, this bearing of the rocker—as long as the eccentric bolt is rotated only by a small angle—can be displaced approximately in a direction which encloses an angle of 90° with the direction in which the bearing 9' of the rocker is moved by rotating the eccentric bolt allocated thereto. The bearing 9' of the rocker can be displaced in approximately horizontal direction, according to FIG. 5, and the bearing 9 of the rocker in approximately vertical direction, according to FIG. 4. This is illustrated by the arrows in FIGS. 4 and 5.

Skew positions of the rolls 1 and 3 can easily be eliminated in the following manner: At first one of the two bearings of the rocker is displaced until the roll axis of roll 3 is in a plane formed by the center of the bearing and the direction of displacement of the other bearing and which is directed parallel to the roll axis of roll 1. Then the other bearing is to be displaced until the rolls are parallel to each other.

If both rolls of the driving roll stand are arranged in rockers pivotably mounted on a stationary stand, it is advantageous to hinge both rockers to the stationary stand by means of eccentric bolts.

Instead of the eccentric bolts, which allow for a displacement of each bearing of the rocker in only one direction and only by small angles of rotation and thus only for correspondingly short adjustment paths, each bearing of the rocker can also be displaceably arranged in a straight-line guide mechanism, wherein the straight-line guide mechanisms enclose a certain angle with each other, preferably an angle of 90°.

What I claim is:

1. In a driving roll stand, in particular to be used in a continuous casting plant, said stand including a pair of generally cylindrical rolls with generally parallel axes, one of said rolls being mounted at both ends in a rocker and the other roll being mounted at both ends in a stationary stand, and a first bearing and a second bearing mounted on the stationary stand for pivotably hinging said rocker to said stationary stand adjacent the ends of each roller, the improvement comprising displacement means for independently displacing said first bearing and second bearing in different directions in the pivot plane of said rocker in order to correct for skew between the axes of the rolls by moving one end of the roll in the rocker in one direction and the other end in another direction.

2. A driving roll stand as set forth in claim 1, wherein the displacement direction of the first bearing of the rocker is perpendicular to the displacement direction of the second bearing of the rocker.

3. A driving roll stand as set forth in claim 1, wherein the displacement means are two eccentric bolts for mounting the bearings on the stationary stand via passages in the stationary stand, one of the bolts penetrates said first bearing and the other penetrates said second bearing, the eccentric bolts having one axis aligned with the passages in the stationary stand and another axis aligned with the pertaining bearing axis, the eccentricities of the bolts being arranged at right angles to each other prior to a displacement of the rocker.

* * * * *

UNITED STATES PATENT AND TRADEMARK OFFICE

CERTIFICATE OF CORRECTION

PATENT NO. : 4,156,453

DATED : May 29, 1979

INVENTOR(S) : Alois Scheinecker

It is certified that error appears in the above-identified patent and that said Letters Patent are hereby corrected as shown below:

On The Title Page assignee, should read

-- Vereinigte Österreichische Eisen— und Stahlwerke - Alpine Montan Aktiengesellschaft --.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*